US007427922B2

(12) United States Patent
Ikehira et al.

(10) Patent No.: US 7,427,922 B2
(45) Date of Patent: Sep. 23, 2008

(54) REMOTE VISITOR MONITORING SYSTEM

(75) Inventors: Kimimasa Ikehira, Hadano (JP); Masanori Ohtsuka, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 530 days.

(21) Appl. No.: 11/039,868

(22) Filed: Jan. 24, 2005

(65) Prior Publication Data

US 2005/0165907 A1 Jul. 28, 2005

(30) Foreign Application Priority Data

Jan. 22, 2004 (JP) ..... 2004-013739

(51) Int. Cl.
*G08B 23/00* (2006.01)

(52) U.S. Cl. ..... 340/573.1; 340/5.7; 340/539.13; 340/539.16; 340/692; 235/382; 705/1

(58) Field of Classification Search ..... 340/573.1, 340/539.11, 539.13, 539.16, 5.2, 5.6, 692, 340/5.7; 235/382; 705/1, 5; 709/217–219
See application file for complete search history.

(56) References Cited

U.S. PATENT DOCUMENTS

2002/0082859 A1* 6/2002 Lancos et al. ..... 705/1
2003/0043040 A1* 3/2003 Zeps et al. ..... 340/573.1
2004/0089709 A1* 5/2004 Frick et al. ..... 235/375

FOREIGN PATENT DOCUMENTS

| | | | |
|---|---|---|---|
| JP | 6-32109 | | 4/1994 |
| JP | 7-3130 | | 1/1995 |
| JP | 10301984 | A * | 11/1998 |
| JP | 2001317958 | A * | 11/2001 |
| JP | 2004094431 | A * | 3/2004 |

OTHER PUBLICATIONS

U.S. Appl. No. 11/319,475, filed Dec. 29, 2005, Ikehira et al.

* cited by examiner

*Primary Examiner*—Thomas J Mullen, Jr.
(74) *Attorney, Agent, or Firm*—Oblon, Spivak, McClelland, Maier & Neustadt, P.C.

(57) ABSTRACT

A visitor monitoring system includes a reading device that reads personal data of a visitor from an identification medium, a terminal device that converts the personal data into digital data, and a remote database formed in a database server, which is connected to the terminal device via a communications line, and including precise digital personal data. The read and converted personal data is corrected and equalized with corresponding precise digital personal data before forming a new database in the remote database.

19 Claims, 4 Drawing Sheets

REMOTE VISITOR MONITORING SYSTEM

CROSS-REFERENCE TO RELATED DOCUMENT

This patent document claims priority under 35 USC § 119 to Japanese Patent Application No. 2004-013739 filed on Jan. 22, 2004, the entire contents of which are herein incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to data processing systems, and in particular, to data processing systems that appropriately monitor a plurality of visitors who enter into and exit from an event hall or the like, while increasing workability.

2. Discussion of the Background Art

Security is becoming more important these days, in particular, monitoring when someone enters into a house or a company.

A house entering-exiting monitoring system has been proposed. For example, an electric lock is employed and is controlled to operate in accordance with an ID code or an ID card of a visitor who enters in a room, as discussed in Examined Japanese Patent Publication No. 6-32109.

Further, various access control methods have been proposed as security systems. For example, in one method a plurality of access control levels are set such that an ID card or a secret identification code is requested, a lock or a free pass is given, and an anticrime sensor is set. One of the access control methods is then selected in accordance with a time zone to timely achieve security while increasing usability, as discussed in Examined Japanese Patent Publication No. 7-3130.

However, it is a primary objective in the above-mentioned background arts to prevent a suspicious person or the like from entering into a room, but such background arts do not control nor count a number of visitors who enter into and exit from an indoor or outdoor assembly hall, such as an event hall, a show floor, etc. Thus, a technology of appropriately controlling and counting such a number is still demanded.

Specifically, although the number of visitors attending events and shows has recently increased, visitors entering and exiting an event hall are typically controlled by requesting that the visitors sign-in on a sheet prepared on a reception desk. However, such a control causes a jam of visitors at the reception desk, and a total number of entrances or departures cannot be quickly determined. Further, when such counting is made to control the event and the show, names or the like filled in on the sheet are either transcribed on a counting sheet or input to a computer or the like, which results in poor workability.

Further, the importance of security has recently increased for a computer room or floor, as well as an office equipment room or floor. Furthermore, it is increasingly demanded to readily grasp an activity of a person only by processing data of an ID card upon its usage. Furthermore, central and local governments are increasingly issuing IC cards as a social infrastructure to identify persons and storing their data.

Accordingly, an object of the present invention is to address and resolve the above-noted and other problems and provide a new visitor monitoring system. The above and other objects are achieved according to a non-limiting embodiment of the present invention by providing a novel visitor monitoring system including: a reading device that reads personal data of a visitor from an identification medium; a terminal device that converts the personal data into digital data; and a remote database that pre-stores precise digital personal data. The read and converted personal data is corrected and equalized with that previously stored in the database. The corrected personal data is stored in a new database, and can be displayed on a display.

In another non-limiting embodiment, the database is located remotely from the reading device and is connected to the terminal device via a prescribed communications line.

In yet another non-limiting embodiment, a terminal device side database is provided on the terminal device side to temporarily store read and converted personal data. The temporarily stored personal data is automatically or manually compared with that stored in the remote database. Only matching personal data is then stored in the new database.

In yet another non-limiting embodiment, the terminal device side database is connected to the remote database via the communications line, wherein the personal data of the terminal device side database is compared and equalized with that of the remote database at a prescribed interval.

In yet another non-limiting embodiment, personal data is read and stored in the terminal device side database when a connection between the terminal device side database and the remote database is invalid. Further, personal data of the terminal device side database is compared and equalized with that of the remote database when the communications are valid.

In yet another non-limiting embodiment, two or more terminal devices include the terminal device side databases, respectively. The personal data of the respective terminal device side databases are compared and equalized with each other at a prescribed interval. Further, the personal data of the terminal device side database is compared and equalized with that of the remote database at a prescribed interval.

In yet another non-limiting embodiment, the terminal device is serially connected to the reading device on one side and to the remote database via Ethernet on the other side.

In yet another non-limiting embodiment, two or more terminal devices and at least one terminal device side database are connected to a common network. Personal data of the terminal device side database is compared with that of the remote database, and only matching personal data is stored in the new database.

In yet another non-limiting embodiment, a display is arranged on the remote database side and communicates with the terminal device side database to display the personal data stored in the terminal device side database.

In yet another non-limiting embodiment, the terminal device assigns location data, which identifies the reading device or the terminal device, to the personal data.

In yet another non-limiting embodiment, the reading device and the terminal device are arranged in the vicinity of an entrance door of a room requiring permission. A database server transmits a signal formed by superposing a voice signal on an operational signal to the terminal device when receiving personal data from the reading device. The terminal device outputs guidance information based upon the voice signal, and locks and unlocks the entrance door based upon the operational signal.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
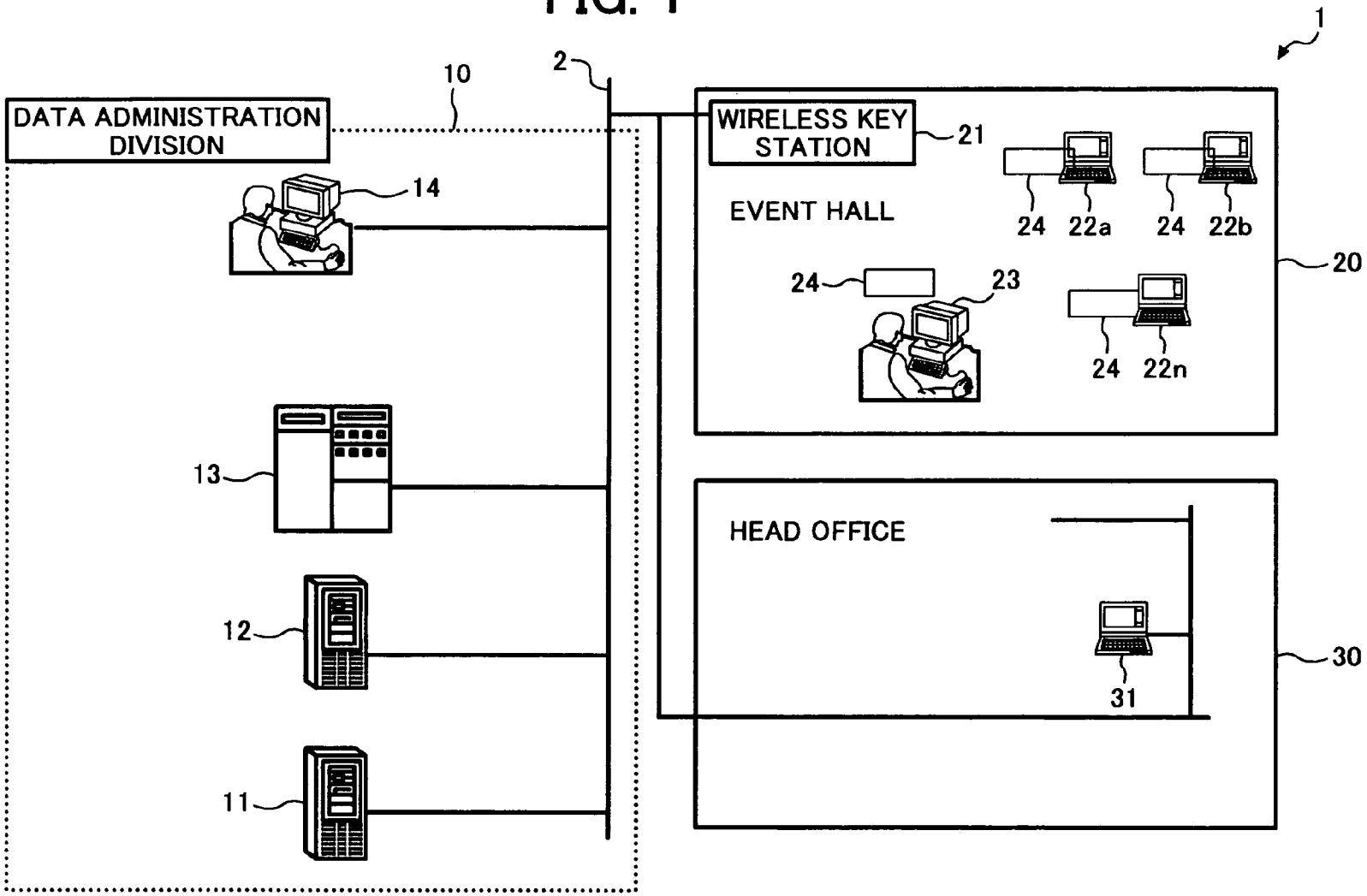
FIG. 1 illustrates an exemplary system construction of a data processing system of one embodiment according to the present invention.

Referring now to the drawings, wherein like reference numerals and marks designate identical or corresponding parts throughout the several figures, in particular to FIG. 1, an exemplary data processing system 1 is described. As shown, a data administrative section 10, an event hall 20, and an event head office 30 are connected by a network 2, such as a LAN (Local Area Network), a WAN (Wide Area Network), etc. The network 2 may include Ethernet (TM), which communicates data in a packet.

The data administrative section 10 includes a data storage server 11, a program storage server 12, a retrieval server 13, and an administrator terminal 14 and the like. Each of these servers 11 to 13 is connected to the administrator terminal 14 via the network 2.

The data storage server 11 stores substantially precise digital personal data related to an administrative objective. A form of data definition of the digital personal data can be made by an SQL (Structured Query Language) or the like. The digital personal data can include a personal name, a company name, a name of a belonging division, a telephone number, a name of a business place, a mail address, and a card number of the administrative objective or the like.

The program storage server 12 stores at least a data processing program for executing data processing as well as system data required when the data processing program is executed. The data processing system 1 executes data processing in accordance with the data processing program.

The retrieval server 13 retrieves digital personal data stored in the data storage server 11 based upon various retrieval conditions, which include requests from the terminals of the administrator 14, the head office 30, and the event hall 20. The retrieval server 13 then returns retrieval results to the requesting terminals, respectively.

The administrator terminal 14 employs a personal computer, for example, a desktop or lap top computer, and is used by an administrator of the data processing system 1 to execute various operations necessary in administrating the data processing system 1. Each of the data storage server 11, the program storage server 12, the retrieval server 13, and the administrator terminal 14 includes a display, which can display personal data indicating situations of entering and exiting visitors on the data storage server 11 side.

Figure 2:
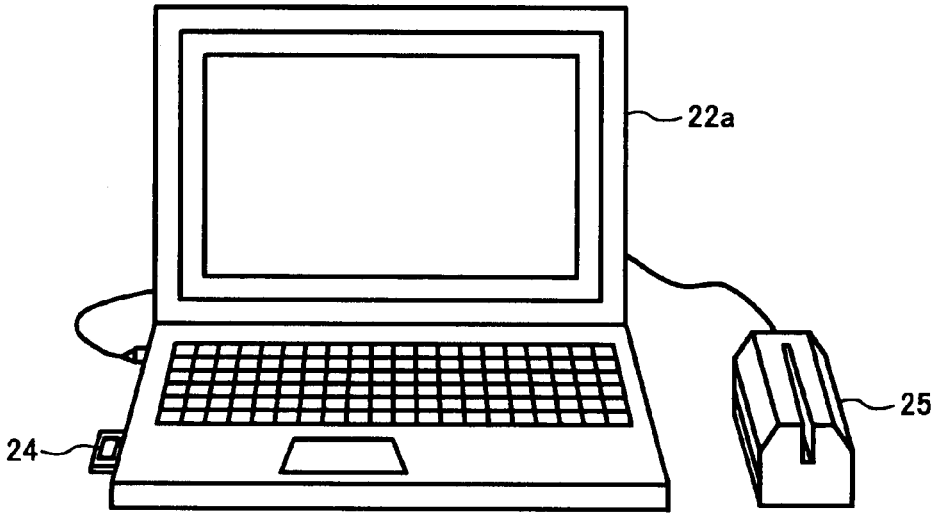
FIG. 2 illustrates the reception terminal and the magnetic card reader shown in FIG. 1.

A wireless key station 21, a plurality of reception terminals 22*a* to 22*n*, and a retrieval terminal 23 and the like are arranged in the event hall 20 remote from the data administrative section 10. Each of the respective reception terminals 22*a* to 22*n* and the retrieval terminal 23 include a wireless LAN access card 24 that communicates with the key station 21 wirelessly as well as a magnetic card reader 25 as shown in FIG. 2. Wired communication could of course also be used.

The wireless key station 21 is connected to the network 2. Each of the reception terminals 22*a* to 22*n* executes data communication with the wireless key station 21 via the wireless LAN access card 24 wirelessly. The reception terminals 22*a* to 22*n* can mutually communicate with each other via the wireless key station 21.

The magnetic card reader 25 is serially connected to each of the reception terminals 22*a* to 22*n* via a serial interface such as RS232C or the like. The magnetic card reader 25 reads and outputs personal data recorded in the magnetic card 41 to an applicable one of the reception terminals 22*a* to 22*n* when a visitor enters into the event hall 20 and manipulates his or her personal identification medium, such as a magnetic card 41 (i.e., an ID card 40), as illustrated in FIG. 3.

Specifically, the reception terminals 22*a* to 22*n* are arranged on reception tables or the like to accept entries of the visitors to the event hall 20, and each controls the magnetic card reader 25 to read the magnetic card 41 used by visitors when entering and exiting the event hall 20.

The magnetic card 41 includes at least personal data, such as a name of a person, a name of a company, and a name of a belonging division, a telephone number, a name of a business place, a mail address, a card number, and etc., which identifies such a visitor. The personal data is read by the magnetic card reader 25, and is input to an applicable one of the reception terminals 22*a* to 22*n*. The personal data is further transmitted and is ultimately stored in a new database in the data storage server 11.

Figure 3:
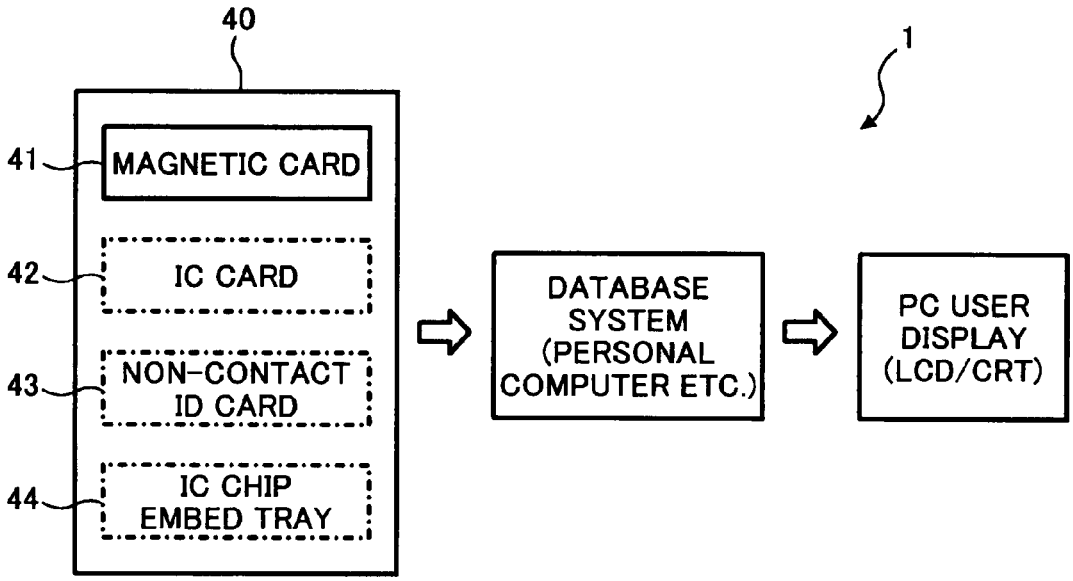
FIG. 3 illustrates an exemplary data processing executed by the data processing system of FIG. 1.

The ID card 40 is not limited to the magnetic card 41, and can include an IC card 42, a non-contact ID card 43, an IC chip embedded tray 44 and the like, as shown in FIG. 3. In accordance with a type of the ID card 40, a prescribed reader, such as an IC card reader, a non-contact ID card reader, etc., is connected to each of the reception terminals 22*a* to 22*n* beside the magnetic card reader 25 to read the ID card 40.

Then, each of the reception terminals 22*a* to 22*n* converts the personal data read from the magnetic card 41 into digital personal data and transmits the digital personal data to the data storage server 11 via the network 2.

The retrieval terminal 23 employs a personal computer such as a desktop or lap top computer or the like and the wireless LAN access card 24 as an attachment. The retrieval terminal 23 accesses the data storage server 11 and retrieves information indicating a current status of entering and exiting visitors via the wireless LAN access card 24, the wireless key station 21, and the network 2, and exports the information to a display thereof.

A situation monitor terminal 31 such as a desktop or lap top personal computer is arranged in the head office 30. The situation monitor terminal 31 is connected to the network 2 and accesses the data storage server 11, and retrieves and displays information indicating a current status of entering and exiting visitors.

Now, an exemplary operation according to one non-limiting embodiment of the present invention will be described.

Some databases are formed in the data storage server 11 to monitor entering and exiting visitors.

A visitor applies a magnetic card 41 to the magnetic card reader 25 when entering and exiting the event hall 20.

Figure 4:
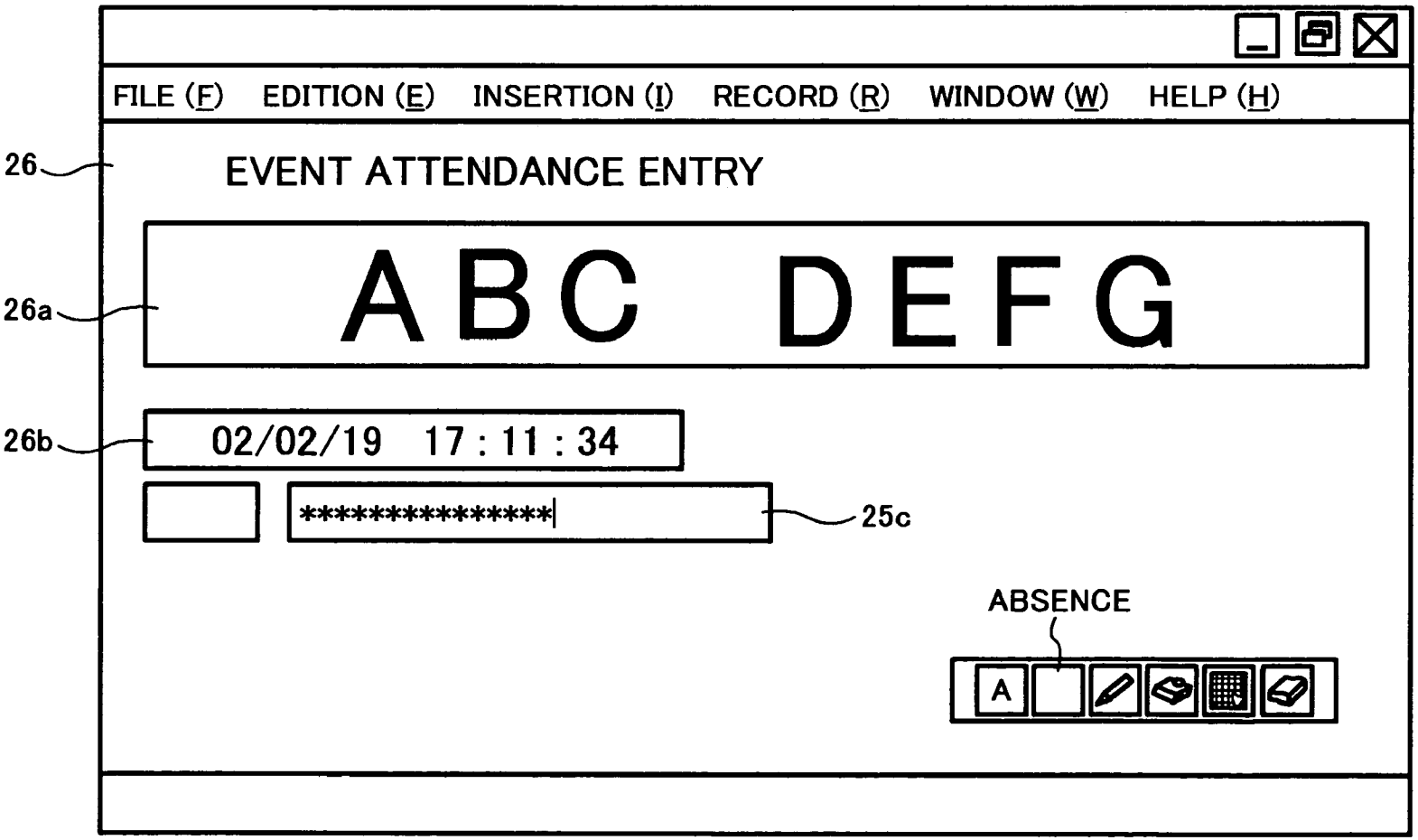
FIG. 4 illustrates an exemplary display screen provided in the reception terminal of FIG. 2.

The magnetic card reader 25 generates a sound to report a completion of reading when having precisely read personal data from the magnetic card 41. As shown in FIG. 4, data fields 26*a*, 26*b*, and 25*c* are then formed on the display screen 26 of an applicable one of the reception terminals 22*a* to 22*n* to indicate information of a visitor name, a date, and an input waiting condition, respectively. For example, the data field 25*c* displays prescribed marks during reading of the magnetic card 41, and the data field 26*a* displays a name of a visitor when the reading of the magnetic card 41 is completed. When the magnetic card 41 is read, each of the reception terminals 22*a* to 22*n* displays, on the display 26, and transmits personal data read from the magnetic card 41 to the data storage server 11 via the wireless LAN access card 24, the wireless key station 21, and the network 2. The data storage server 11 then compares the digital personal data transmitted from one of the reception terminals 22*a* to 22*n* with the precise digital personal data stored in the data storage server 11, correspondingly. The data storage server 11 then corrects (i.e., equalizes with the precise digital personal data) and stores the digital personal data in a new database. Because, when a manufacturer who does not know the system well newly manufactures an ID card, personal data in the ID card is sometimes slightly different from the correct personal data. Thus, such personal data should be corrected before forming a database. The data storage server 11 then displays the corrected digital personal data on the display.

When the retrieval terminal 23 requests retrieval or totaling of entering and exiting visitors, the request is transmitted to the data storage server 11 via the wireless LAN access card 24, the wireless key station 21, and the network 2. Status data related to entering and exiting visitors is then retrieved and totaled, and the results are displayed on a display of the retrieval terminal 23.

Further, when the monitor terminal 31 requests retrieval or totaling of status data of entering and exiting visitors, the request is similarly transmitted and accessed by the data storage server 11 via the network 2. Then, status data of entering and exiting visitors is retrieved and totaled, and the results are displayed on a display of the monitor terminal 31.

Further, each of the reception terminals 22*a* to 22*n* is serially connected to the magnetic card reader 25, and the data storage server 11 via an Ethernet (™).

The data storage server 11 can be a mobile computer such as a lap top computer, etc., and can be used in the event hall 20. Further, the personal data can be temporarily stored in a hard disk of each of the reception terminals 22*a* to 22*n*, and is either automatically or manually compared with precise digital personal data stored in the data storage server 11. Then, slightly different personal data is corrected and equalized with the precise digital personal data so that only correct data can be stored in the new database in the data storage server 11.

Further, the personal data can be stored in an applicable one of the reception terminals 22*a* to 22*n* while being transmitted to the data storage server 11. The personal data can then be compared with the previously stored precise digital personal data in the data storage server 11. As a result, only correct personal data can be stored in the new database in the data storage server 11 as mentioned above.

Furthermore, personal data databases that are substantially the same as those in the data storage server 11 can be formed either in each of the reception terminals 22*a* to 22*n* and the retrieval terminal 23, or only in the retrieval terminal 23. Specifically, personal data is read and stored in a database provided in the event hall 20 every time the magnetic card reader 25 recognizes entering or exiting visitors. The personal data of the database in the event hall 20 can then be compared with that previously stored in the database of the data storage server 11, correspondingly, at a prescribed interval so that only matching data can be stored in the new database.

Further, the magnetic card reader 25 can read and store digital personal data in the databases of the reception terminals 22*a* to 22*n* while connection between the databases and the data storage server 11 is invalid. When the connection is valid, the digital personal data of the databases of the reception terminals 22*a* to 22*n* can be compared and equalized with that of the data storage server 11.

Further, a plurality of databases can be formed in a plurality of hard disks or the like, respectively disposed in the reception terminals 22*a* to 22*n*. Then, all the digital personal data of one database is mutually compared and equalized with the data of the other database at a prescribed interval. Then, the equalized digital personal data and that of the data storage server 11 can be compared and equalized with each other at a prescribed interval.

Further, the reception terminals 22*a* to 22*n* and the databases can be connected to a common network. Then, digital personal data of the database can be compared with that correspondingly stored in the database of the data storage server 11. Then, only digital personal data of an applicable one of the reception terminals 22*a* to 22*n* that matches with digital personal data in the database of the data storage server 11 can be stored in the new database of the data storage server 11.

Further, any one of the displays of the data storage server 11, the program storage server 12, the retrieval server 13, and the administrator terminal 14 can obtain and show personal data stored in the new database of the reception terminals 22*a* to 22*n* via the network 2.

Further, each of the reception terminals 22*a* to 22*n* can assign location data, which identifies the magnetic card reader 25 or one of the reception terminals 22*a* to 22*n*, to digital personal data when that is read and converted by the magnetic card reader 25.

Further, the magnetic card readers 25 and one of the reception terminals 22*a* to 22*n* can be arranged in the vicinity of an entrance door of a room as a required security objective to conditionally permit entrance to a visitor. Thus, the magnetic card reader 25 reads personal data stored in the magnetic card 41 of an entering or exiting visitor. Upon receipt of digital personal data from one of the reception terminals 22*a* to 22*n*, the data storage server 11 transmits a signal formed by superposing a voice signal on an operational signal to one of the reception terminals 22*a* to 22*n*. Then, one of the reception terminals 22*a* to 22*n* can output and report guidance information based upon the voice signal, and can lock and unlock the door based upon the operational signal.

Figure 5:
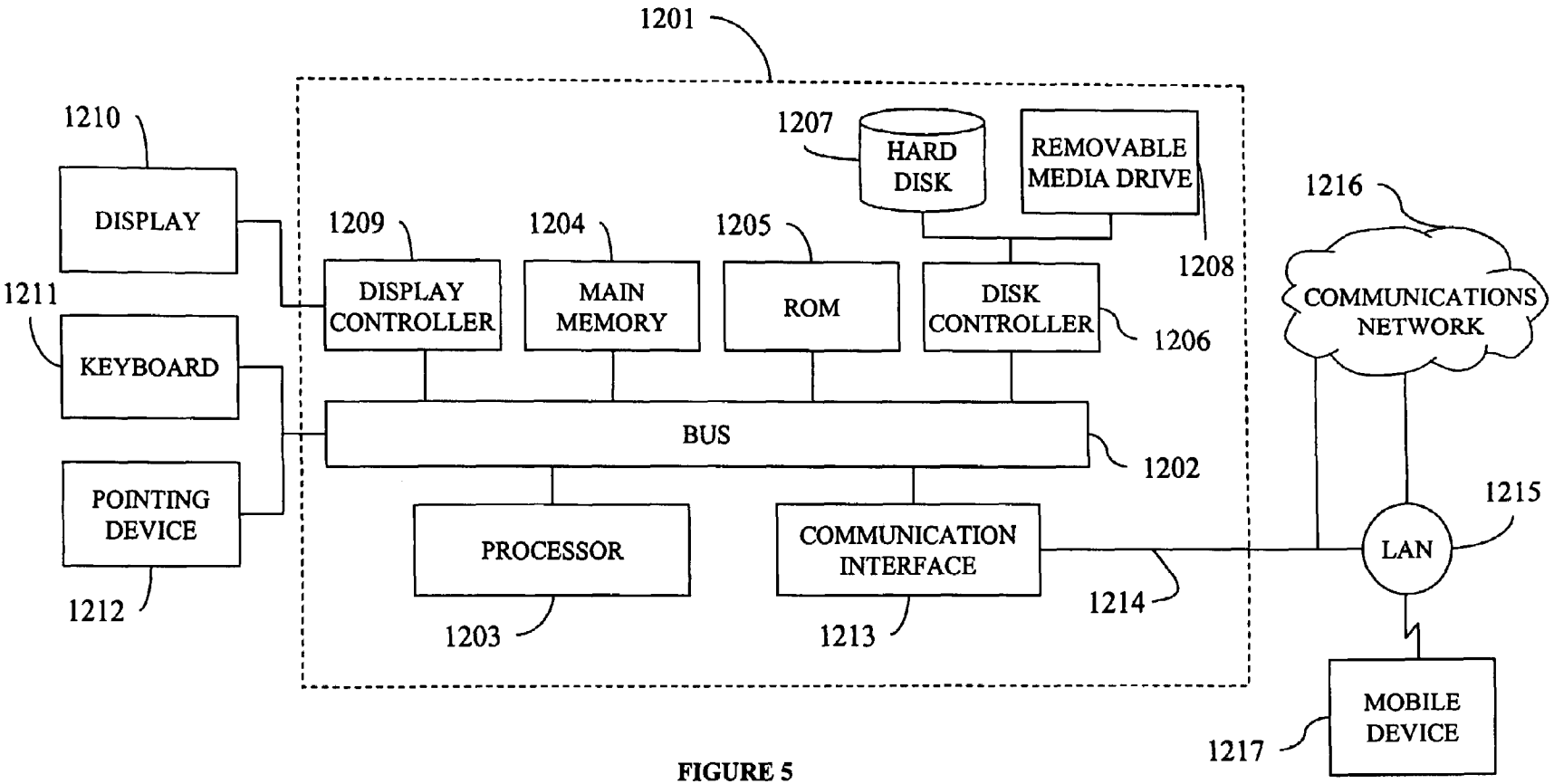
FIG. 5 is a block diagram of a computer system upon which an embodiment of the present invention may be implemented.

FIG. 5 illustrates a computer system 1201 upon which an embodiment of the present invention may be implemented. The computer system 1201 includes a bus 1202 or other communication mechanism for communicating information, and a processor 1203 coupled with the bus 1202 for processing the information. The computer system 1201 also includes a main memory 1204, such as a random access memory (RAM) or other dynamic storage device (e.g., dynamic RAM (DRAM), static RAM (SRAM), and synchronous DRAM (SDRAM)), coupled to the bus 1202 for storing information and instructions to be executed by processor 1203. In addition, the main memory 1204 may be used for storing temporary variables or other intermediate information during the execution of instructions by the processor 1203. The computer system 1201 further includes a read only memory (ROM) 1205 or other static storage device (e.g., programmable ROM (PROM), erasable PROM (EPROM), and electrically erasable PROM (EEPROM)) coupled to the bus 1202 for storing static information and instructions for the processor 1203.

The computer system 1201 also includes a disk controller 1206 coupled to the bus 1202 to control one or more storage devices for storing information and instructions, such as a magnetic hard disk 1207, and a removable media drive 1208 (e.g., floppy disk drive, read-only compact disc drive, read/write compact disc drive, compact disc jukebox, tape drive, and removable magneto-optical drive). The storage devices may be added to the computer system 1201 using an appropriate device interface (e.g., small computer system interface (SCSI), integrated device electronics (IDE), enhanced-IDE (E-IDE), direct memory access (DMA), or ultra-DMA).

The computer system 1201 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 1201 may also include a display controller 1209 coupled to the bus 1202 to control a display 1210, such as a cathode ray tube (CRT), for displaying information to a computer user. The computer system includes input devices, such as a keyboard 1211 and a pointing device 1212, for interacting with a computer user and providing information to the processor 1203. The pointing device 1212, for example, may be a mouse, a trackball, or a pointing stick for communicating direction information and command selections to the processor 1203 and for controlling cursor movement on the display 1210. In addition, a printer may provide printed listings of data stored and/or generated by the computer system 1201.

The computer system 1201 performs a portion or all of the processing operations of the invention in response to the processor 1203 executing one or more sequences of one or more instructions contained in a memory, such as the main memory 1204. Such instructions may be read into the main memory 1204 from another computer readable medium, such as a hard disk 1207 or a removable media drive 1208. One or more processors in a multi-processing arrangement may also be employed to execute the sequences of instructions contained in main memory 1204. In alternative embodiments, hard-wired circuitry may be used in place of or in combination with software instructions. Thus, embodiments are not limited to any specific combination of hardware circuitry and software.

As stated above, the computer system 1201 includes at least one computer readable medium or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, punch cards, paper tape, or other physical medium with patterns of holes, a carrier wave (described below), or any other medium from which a computer can read.

Stored on any one or on a combination of computer readable media, the present invention includes software for controlling the computer system 1201, for driving a device or devices for implementing the invention, and for enabling the computer system 1201 to interact with a human user (e.g., print production personnel). Such software may include, but is not limited to, device drivers, operating systems, development tools, and applications software. Such computer readable media further includes the computer program product of the present invention for performing all or a portion (if processing is distributed) of the processing performed in implementing the invention.

The computer code devices of the present invention may be any interpretable or executable code mechanism, including but not limited to scripts, interpretable programs, dynamic link libraries (DLLs), Java classes, and complete executable programs. Moreover, parts of the processing of the present invention may be distributed for better performance, reliability, and/or cost.

The term "computer readable medium" as used herein refers to any medium that participates in providing instructions to the processor 1203 for execution. A computer readable medium may take many forms, including but not limited to, non-volatile media, volatile media, and transmission media. Non-volatile media includes, for example, optical, magnetic disks, and magneto-optical disks, such as the hard disk 1207 or the removable media drive 1208. Volatile media includes dynamic memory, such as the main memory 1204. Transmission media includes coaxial cables, copper wire and fiber optics, including the wires that make up the bus 1202. Transmission media also may also take the form of acoustic or light waves, such as those generated during radio wave and infrared data communications.

Various forms of computer readable media may be involved in carrying out one or more sequences of one or more instructions to processor 1203 for execution. For example, the instructions may initially be carried on a magnetic disk of a remote computer. The remote computer can load the instructions for implementing all or a portion of the present invention remotely into a dynamic memory and send the instructions over a telephone line using a modem. A modem local to the computer system 1201 may receive the data on the telephone line and use an infrared transmitter to convert the data to an infrared signal. An infrared detector coupled to the bus 1202 can receive the data carried in the infrared signal and place the data on the bus 1202. The bus 1202 carries the data to the main memory 1204, from which the processor 1203 retrieves and executes the instructions. The instructions received by the main memory 1204 may optionally be stored on storage device 1207 or 1208 either before or after execution by processor 1203.

The computer system 1201 also includes a communication interface 1213 coupled to the bus 1202. The communication interface 1213 provides a two-way data communication coupling to a network link 1214 that is connected to, for example, a local area network (LAN) 1215, or to another communications network 1216 such as the Internet. For example, the communication interface 1213 may be a network interface card to attach to any packet switched LAN. As another example, the communication interface 1213 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1213 sends and receives electrical, electromagnetic or optical signals that carry digital data streams representing various types of information.

The network link 1214 typically provides data communication through one or more networks to other data devices. For example, the network link 1214 may provide a connection to another computer through a local network 1215 (e.g., a LAN) or through equipment operated by a service provider, which provides communication services through a communications network 1216. The local network 1214 and the communications network 1216 use, for example, electrical, electromagnetic, or optical signals that carry digital data streams, and the associated physical layer (e.g., CAT 5 cable, coaxial cable, optical fiber, etc). The signals through the various networks and the signals on the network link 1214 and through the communication interface 1213, which carry the digital data to and from the computer system 1201 maybe implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The computer system 1201 can transmit and receive data, including program code, through the network(s) 1215 and 1216, the network link 1214 and the communication interface 1213. Moreover, the network link 1214 may provide a connection through a LAN 1215 to a mobile device 1217 such as a personal digital assistant (PDA) laptop computer, or cellular telephone.

Numerous additional modifications and variations of the present invention are possible in light of the above teachings. It is therefore to be understood that within the scope of the appended claims, the present invention may be practiced otherwise than as specifically described herein.

What is claimed is:

1. A visitor monitoring system, comprising:

a reading device configured to read personal data of a visitor from an identification medium;

at least one terminal device configured to convert the personal data into digital information;

a first database configured to include pre-stored digital personal data, said first database formed in a database server; and a display device configured to display contents of a database;

wherein said digital information is compared and equalized with corresponding pre-stored digital personal data before a new database is formed.

2. The visitor monitoring system according to claim 1, wherein said first database is configured to connect to the at least one terminal device via a prescribed communications line.

3. The visitor monitoring system according to claim 2, further comprising a terminal device side database formed on a terminal device side and configured to temporarily store the digital information, wherein the temporarily stored digital information is automatically or manually compared with the pre-stored digital personal data in the first database, and only personal data that matches is stored in the new database.

4. The visitor monitoring system according to claim 3, wherein said terminal device side database is configured to connect to the first database via the prescribed communications line, and wherein the digital information of the terminal device side database is compared and equalized with the pre-stored digital personal data in the first database at a prescribed interval.

5. The visitor monitoring system according to claim 4, wherein said digital information is read and stored in the terminal device side database when a connection between the terminal device side database and the first database is invalid, and wherein the digital information of the terminal device side database is compared and equalized with the pre-stored digital personal data of the first database when the connection between the terminal device side database and the first database is valid.

6. The visitor monitoring system according to claim 5, wherein a plurality of terminal devices each include the terminal device side database, and said digital information of respective terminal device side databases is compared and equalized with each other at a prescribed interval, and wherein the digital information of one of the terminal device side databases is compared and equalized with the pre-stored digital personal data of the first database at a prescribed interval.

7. The visitor monitoring system according to claim 4, wherein at least two terminal devices and at least one terminal device side database are configured to connect to a common network, and wherein said digital information of the terminal device side database is compared with that of the first database, and only matching personal data is stored in the new database.

8. The visitor monitoring system according to claim 7, wherein the display device is arranged on a first database side, and said display device is configured to communicate with the terminal device side database and to display digital information stored in the terminal device side database.

9. The visitor monitoring system according to claim 7, wherein said terminal device assigns location data to the digital information, said location data identifying one of the reading device and the terminal device.

10. The visitor monitoring system according to claim 2, wherein said terminal device is configured to serially connect to the reading device on one side and to the first database via Ethernet on another side.

11. The visitor monitoring system according to claim 1, wherein the reading device and the terminal device are arranged in a vicinity of an entrance door of a room, wherein the database server is configured to transmit a signal to the terminal device when the terminal device receives personal data from the reading device, said signal being formed by superposing a voice signal on an operational signal, and said terminal device is configured to output guidance information based upon the voice signal, and is configured to lock and unlock an entrance door based upon the operational signal.

12. The visitor monitoring system according to claim 1, wherein compared and equalized personal data is displayed on the display device.

13. A method of monitoring visitors entering and exiting a room, comprising:

reading personal data of a visitor from an identification medium;

converting the personal data into digital information;

pre-storing digital personal data in a first database, said first database formed in a database server;

displaying contents of a database; and comparing and equalizing said digital information with corresponding pre-stored digital personal data before forming a new database.

14. The method of claim 13, further comprising:

forming a terminal device side database on a terminal device side;

temporarily storing digital information in said terminal device side database;

comparing the temporarily stored digital information with the pre-stored digital personal data in the first database; and storing matching personal data in the new database.

15. The method of claim 14, further comprising:

storing digital information in the terminal device side database while a connection between the terminal device side database and the first database is invalid; and comparing and equalizing the digital information with the pre-stored digital personal data of the first database when the connection between the terminal device side database and the first database is valid.

16. The method of claim 15, wherein the displaying further comprises:

communicating with the terminal device side database and displaying digital information stored in the terminal device side database.

17. The method of claim 15, further comprising:

transmitting a signal to the terminal device side, said signal being formed by superposing a voice signal on an operational signal; and outputting guidance information based upon the voice signal; and locking and unlocking an entrance door based upon the operational signal.

18. The method of claim 15 further comprising:

assigning location data to the digital information, said location data identifying one of a reading device or the terminal device side.

19. The method of claim 13, further comprising:

displaying compared and equalized data.

* * * * *